US005248330A

United States Patent [19]

Rierson

[11] Patent Number: 5,248,330

[45] Date of Patent: Sep. 28, 1993

[54] METHOD OF PYROPROCESSING MINERAL ORE MATERIAL

[75] Inventor: David W. Rierson, Elm Grove, Wis.

[73] Assignee: Suedala, Inc., Waukesha, Wis.

[21] Appl. No.: 996,576

[22] Filed: Dec. 24, 1992

[51] Int. Cl.[5] ..... C21C 7/02

[52] U.S. Cl. ..... 75/746; 75/527; 75/649

[58] Field of Search ..... 75/746, 649, 527

[56] References Cited

U.S. PATENT DOCUMENTS 3,206,299 9/1965 Senior ..... 75/10.43
3,313,619 4/1967 Decamps ..... 75/527
4,073,646 2/1978 Kryczun .....75/649

*Primary Examiner*—Peter D. Rosenberg

*Attorney, Agent, or Firm*—Robert B. Benson

[57] ABSTRACT

A method of pyroprocessing mineral ores. The method includes forming the mineral ore fines into small balls or pellets, drying and preheating the pellets and then subjecting the pellets to further heat with an oxidizing gas to substantially oxidize and indurate the pellets prior to discharging the pellets into a cooler. The essential equipment used in the process are machines such as a balling pan or drum for agglomerating the ore, a grate traveling through a furnace and a rotary kiln for transporting the pellets from the grate to a cooler. Also, means are provided to supply hot oxidizing gas to both the furnace and the kiln to heat the pellets. In addition, means are provided to supply an oxidizing gas beneath the tumbling bed of pellets in the kiln.

6 Claims, 2 Drawing Sheets

FIG. 2
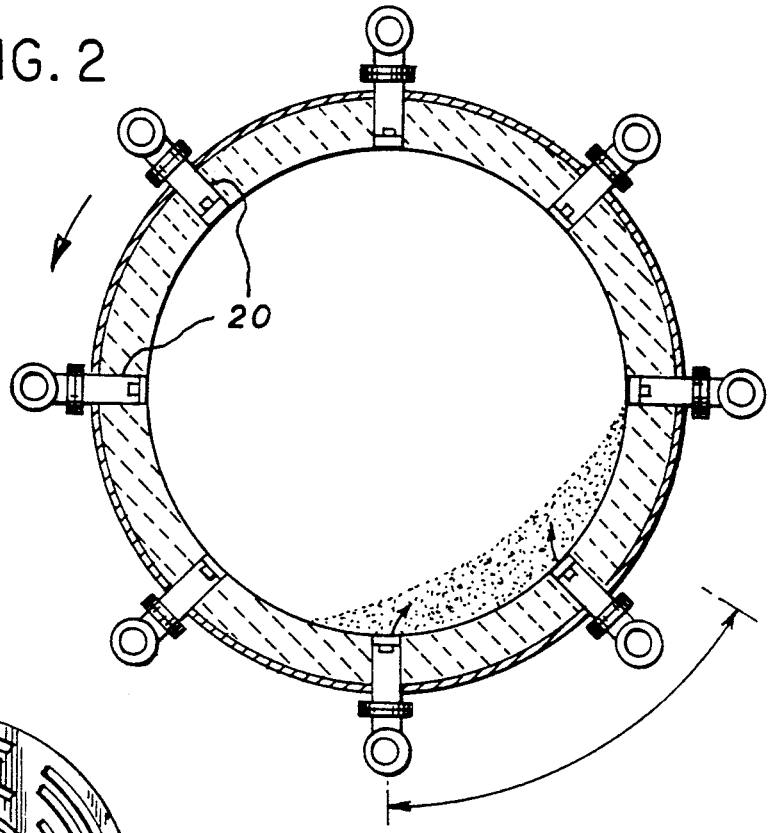
FIG. 4
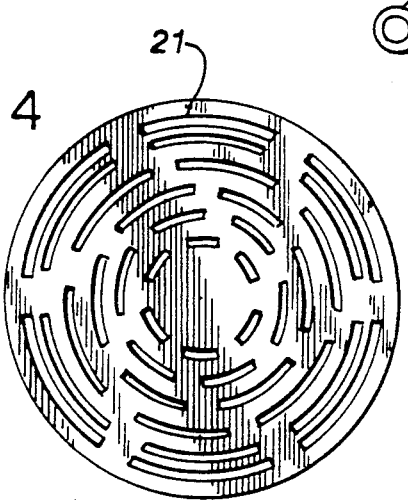
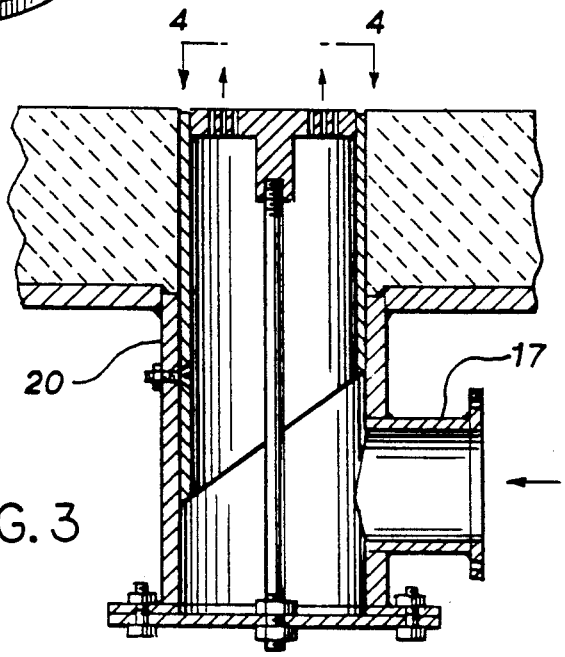
FIG. 3

METHOD OF PYROPROCESSING MINERAL ORE MATERIAL

This invention relate to the pyroprocessing of mineral ores and more specifically to the oxidization and induration of such ores to better prepare them for transportation to remote geographical areas where this treated material can be further processed into useful forms for industry.

DESCRIPTION OF THE PRIOR ART

It is well known that most mineral ores in their natural state are low in concentration relative to a specific element and therefore require beneficiation which renders this mineral ore to a fine powdery consistency which is unsuitable for transportation and many times unsuitable for further processing such as a feed to blast furnaces, open hearth furnaces or electric arc furnaces. A number of methods have been tried, with varying degrees of success, for agglomerating such fine ore particles to make them more suitable for handling, shipping and use in downstream processing equipment. A number of these methods are referred to in U.S. Pat. No. 2,925,336 William F. Stowasser Jr. issued Feb. 16, 1960. That patent was particularly directed to the pyroprocessing and hardening of iron ore but this invention is applicable to other mineral ores in addition to iron ore. The specific method described by Stowasser relates to the use of a traveling grate, a rotary kiln and an annular cooler. The fine powdery ore is formed into balls or pellets in a balling device and then transferred onto a traveling grate where the pellets are subjected to a cross flow of hot gases to dry and initially harden the pellets. While being heated the iron ore pellets begin to oxidize; i.e. converting the magnetite phase of iron to hematite; also, during heating the strength and hardness of the pellets increase. The pellets are then discharged into a directly fired rotary kiln where they are tumbled and subjected to further heating by a counter-flowing oxidizing atmosphere which ranges in temperature from 2200–2450 degrees Fahrenheit. The pellets are subsequently discharged into the annular cooler where during the cooling process they are further oxidized to the point of almost 100 percent oxidation.

One problem with the Stowasser patent is that the pellets are not fully oxidized by the time the pellets discharge from the rotary kiln. The remaining oxidation therefore takes place in the annular cooler. Since oxidation is an exothermic reaction, heat is generated during the conversion of magnetite to hematite. The feed portion of the annular cooler in which this oxidation occurs therefore becomes a furnace and in turn limits the cooling effectiveness of the annular cooler and negatively impacts the production line's throughput.

Recent field sampling data on production lines of iron ore pelletizing plants using a traveling grate, a rotary kiln and an annular cooler indicate that the pellets are 60% to 70% oxidized on the grate. Substantially no oxidation takes place in the kiln and the remaining oxidation takes place in the annular cooler. It is believed that the oxidation of the pellets in the rotary kiln is not completed in current systems because of the ineffective contact between the counter-flowing hot gas above the bed of the pellets and the pellets themselves.

It is postulated with this invention that the oxidation of the pelletized ore will be substantially completed within the rotary kiln. The exothermic heat generated by this oxidation will offset and diminish the amount of externally supplied heat required for processing the ore. Also, by moving this oxidation out of the annular cooler, the cooler is relieved of that exothermic heat burden associated with the conversion of magnetite to hematite, and the cooler can function solely as a cooler and thus become more efficient.

The kiln oxidation is accomplished by introducing an oxidizing gas, such as air, beneath the bed of pellets within the kiln where the oxidizing gas flows radially upward through the tumbling bed of pellets. This radially injected underbed oxidizing gas intimately contacts the surface of the pellets and oxidation occurs. The oxidizing gas flow in this stage can be regulated to insure almost 100% oxidation of the pellets before discharge from the kiln.

Therefore, it is an object of this invention to improve upon the efficiency of oxidizing mineral ores such as magnetite.

Another object of this invention is to provide a system for oxidizing ores using a traveling grate and rotary kiln in which the ore is substantially oxidized prior to being discharged from the kiln.

Although this invention is intended to be applicable to any kind of mineral ore it will be described in detail in connection with pyroprocessing iron ore which is formed originally into relatively soft green pellets.

BRIEF DESCRIPTION OF THE DRAWINGS

FIG. 2 is a cross section view of the ported rotary kiln illustrating the array of ports and graphically showing the process of introducing an oxidizing gas through the tumbling bed of pellets.

FIG. 3 is a longitudinal section of the port which serves as a conduit for introducing the air into the kiln.

FIG. 4 is a top view of the port grid showing the slots through which the oxidizing gas flows into the kiln.

DESCRIPTION OF THE PREFERRED EMBODIMENT

Figure 1:
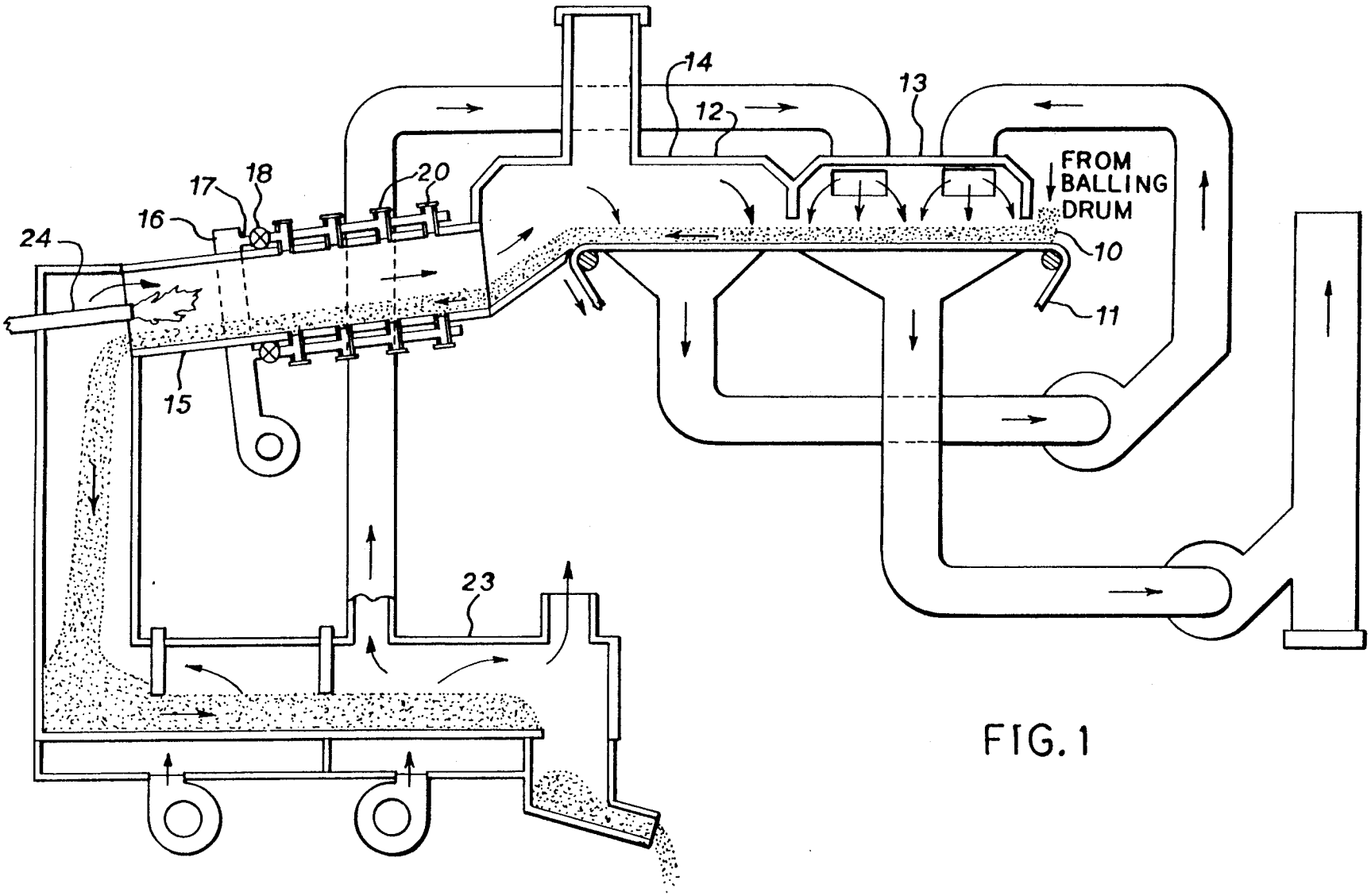
FIG. 1 shows a diagrammatically side elevation partially in section of an equipment set-up comprising a traveling grate preheater having drying and preheating zones, a rotary kiln and an annular cooler all in a series-flow arrangement.

The following is a detailed description of the invention with reference to the drawings. As shown in FIG. 1, raw iron ore pellets 10 are placed on moving, continuous grate 11. The grate travels through furnace 12. Furnace 12 is divided into drying and preheating zones. Pellets 10 on traveling grate 11 are exposed to a downdrafted cross flow of hot oxidizing gases which dry and harden the pellets in preparation for transfer to rotary kiln 15. The pellets must be sufficiently strengthened through heat hardening before reaching the kiln if breaking and crumbling of the pellets is to be avoided.

When pellets 10 are on traveling grate 11 hot oxidizing gas from kiln 15 is drawn down through the bed of pellets to harden the pellets, and to begin the oxidizing process. In the preheating zone the pellets are heated to between 1600-2000 degrees Fahrenheit. It can be noted in the schematic that the hot gas initially comes in over the pellets and then is drawn down through the bed of pellets by an induced draft fan.

The pellets 10 are then delivered to rotary kiln 15 where they are tumbled as they move through the inclined kiln to the discharge. In the kiln the pellets are heated to between 2200–2450 degrees Fahrenheit. In addition an oxidizing gas, such as air or oxygen, is forced underneath the tumbling bed of pellets and flows radially upward through the tumbling bed to improve the contact between the oxidizing gas the tumbling pellets. This is accomplished by force drafting the oxidizing gas into manifold 16 which distributes the gas among piping 17 and valves 18 which in turn deliver the gas into nozzles or ports 20 and then through slots 21 in the port castings and into the rotary kiln. Appropriate control mechanisms are provided to open and close the various valves so that the oxidizing gas is injected when the ports are beneath the tumbling bed of pellets. Such a system, including the valves and nozzles, is disclosed in U.S. Pat. No. 3,946,949.

It is intended that the temperature in the rotary kiln will be maintained at an appropriate level and that the oxidizing gas will be forced through the tumbling bed at an appropriate rate so that substantially all of the pellets are 100 percent oxidized before being discharged from kiln 15 into annular cooler 23. Since oxidation is an exothermic reaction, an amount of heat is generated in the kiln due to the oxidizing reaction, thereby reducing the heat required from centerline burner 24 to drive the oxidizing reaction and complete pellet induration. The remainder of the required process heat is recouperated from annular cooler 23 during pellet cooling.

The temperature and amount of the oxidizing gases and the rate of movement of the body of pellets through the system is correlated so that the temperature at the discharge end of the rotary kiln is maintained at about 2450 degrees Fahrenheit. The depth of the layer of pellets 10 in kiln 15 and the rate at which the pellets are moved through the kiln will determine how much heat has to be supplied to the kiln and how much oxidizing gas must be admitted into the kiln to complete the oxidation of the pellets prior to discharge from the kiln.

Although the invention has been described in connection with the pyroprocessing of iron ore pellets, it could be used for the pyroprocessing of other mineral ores.

The embodiments of the invention in which an exclusive property or privilege is claimed are defined as follows:

1. Method of oxidizing a mineral ore passing through an inclined rotary kiln comprising the steps of:

A. Feeding said mineral ore into the upper end of an inclined rotary kiln so that said mineral ore forms a continuous tumbling mass proceeding through said kiln.

B. Injecting oxidizing gas beneath the tumbling mass to improve the gas-ore interaction.

C. Maintaining a temperature within said kiln sufficient to achieve oxidation of the said mineral ore.

D. Moving said material ore through said kiln at a rate that causes all the ore to be substantially fully oxidized before being discharged from the lower end of said kiln.

2. The method of claim 1 in which the mineral ore is iron.

3. The method of claim 1 in which the oxidizing gas is air.

4. The method of claim 1 in which the ore is balled, dried and partially oxidized to form discreet pellets before being fed into said kiln.

5. The method of claim 1 in which the temperature within the kiln is maintained at between 2200 and 2450 degrees Fahrenheit.

6. The method of claim 1 in which the means for injecting oxidizing gas beneath the tumbling mass in the kiln includes an annular manifold surrounding the kiln and connected to a series of arcuately and longitudinally spaced ports through valves controlled to open when the ports are beneath the tumbling mass in said kiln.

* * * * *

UNITED STATES PATENT AND TRADEMARK OFFICE

CERTIFICATE OF CORRECTION

PATENT NO. : 5,248,330

DATED : September 28, 1993

INVENTOR(S) : David W. Rierson

It is certified that error appears in the above-indentified patent and that said Letters Patent is hereby corrected as shown below:

On the title page, item [73] should read as follows:
[73] Assignee: Svedala Industries, Inc.

Column 1, line 5 the word "relate" should read "relates"

Column 3, line 4 after the word "gas" insert "and"

Column 3, line 26 "recouperated" should be spelled "recuperated"

Column 4, line 26 "discreet" should be spelled "discrete"

Signed and Sealed this

Seventeenth Day of May, 1994

Bruce Lehman

*Attest:*

BRUCE LEHMAN

*Attesting Officer*

*Commissioner of Patents and Trademarks*